US005539508A

United States Patent [19]

Piotrowski et al.

[11] Patent Number: 5,539,508

[45] Date of Patent: Jul. 23, 1996

[54] VARIABLE LENGTH TRANSFER ASSIST APPARATUS

[75] Inventors: Sonya P. Piotrowski, Webster; Brian R. Ford, Walworth, both of N.Y.

[73] Assignee: Xerox Corporation, Stamford, Conn.

[21] Appl. No.: 360,902

[22] Filed: Dec. 21, 1994

[51] Int. Cl.[6] ..... G03G 15/14

[52] U.S. Cl. ..... 355/271; 355/277

[58] Field of Search ..... 355/271, 273, 355/274, 277, 308, 309, 311

[56] References Cited

U.S. PATENT DOCUMENTS

| | | | |
|---|---|---|---|
| 4,101,212 | 7/1978 | Sumiyoshi et al. | 355/274 |
| 4,947,214 | 8/1990 | Baxendell et al. | 355/274 |
| 5,227,852 | 7/1993 | Smith et al. | 355/273 |
| 5,247,335 | 9/1993 | Smith et al. | 355/271 |
| 5,300,993 | 4/1994 | Vetromile | 355/271 |
| 5,300,994 | 4/1994 | Grass et al. | 355/277 |
| 5,400,125 | 3/1995 | Stuerzer et al. | 355/274 |

*Primary Examiner*—Robert Beatty
*Attorney, Agent, or Firm*—Denis A. Robitaille

[57] ABSTRACT

An apparatus for transferring a developed image from a photoconductive surface to a copy sheet. The apparatus includes a continuously variable length contact assembly which is moved from a nonoperative position spaced from the copy sheet, to an operative position, in contact with the copy sheet for pressing the copy sheet into contact with the developed image on the photoconductive surface to substantially eliminate any spaces between the copy sheet and the developed image during transfer of the developed image from the photoconductive surface to the copy sheet. The transfer apparatus is provided with a continuously variable length for selectively corresponding the length of the contact assembly with the process width dimension of the copy sheet.

17 Claims, 2 Drawing Sheets

VARIABLE LENGTH TRANSFER ASSIST APPARATUS

The present invention relates generally to an electrophotographic printing machine, and, more specifically, concerns an apparatus for assisting the transfer of a developed image from a photoconductive imaging surface to a copy sheet.

In a typical electrophotographic copying process, a photoconductive member is charged to a substantially uniform potential and the charged portion of the photoconductive member is subsequently exposed to a light image of an original document being reproduced. Exposure of the charged photoconductive member selectively dissipates the charge thereon in the irradiated areas so as to record on the photoconductive member an electrostatic latent image corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image to form a toner powder image on the photoconductive member. The toner powder image is then transferred from the surface of the photoconductive member to a copy substrate such as a sheet of paper. Thereafter, heat or some other treatment is applied to the toner particles to permanently affix the powder image to the copy substrate.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is selectively deposited on a charge retentive surface in response to an electronically generated or stored image.

The process of transferring charged toner particles from an image bearing member such as the photoconductive member to an image support substrate such as the copy sheet is enabled by overcoming adhesive forces holding the toner particles to the image bearing member. Typically, transfer of developed toner images in electrostatographic applications is accomplished via electrostatic induction using a corona generating device, wherein the image support substrate is placed in direct contact with the developed toner image on the photoconductive surface while the reverse side of the image support substrate is exposed to a corona discharge for generating ions having a polarity opposite that of the toner particles, to electrostatically attract the toner particles from the photoreceptive member and transfer the toner particles to the image support substrate. An exemplary ion emission corotron transfer system is disclosed in U.S. Pat. No. 2,836,725.

As described, the typical process of transferring development materials in an electrostatographic system involves the physical detachment of charged toner particles from an image bearing photoconductive surface and transfer-over to an image support substrate via electrostatic force fields. A critical aspect of the transfer process involves the application and maintenance of high intensity electrostatic fields in the transfer region for overcoming the adhesive forces acting on the toner particles as they rest on the surface of the photoconductive member. In addition, other forces, such as mechanical pressure or vibratory energy, have been used to support and enhance the transfer process. Careful control of electrostatic fields and other forces is essential for inducing the physical detachment and transfer-over of the charged toner particles without scattering or smearing of the developer material which may result in an unsatisfactory output image.

In addition to careful control of electrostatic fields and other forces when electrostatically transferring a toner powder image to a copy sheet, it is generally necessary for the copy sheet to be in intimate contact with the toner particles on the photoconductive surface. However, the interface between the photoconductive surface and the copy substrate is rarely uniform. In particular, non-flat or uneven image support substrates, such as copy sheets that have been mishandled, paper that has been left exposed to the environment, or substrates that have previously passed through a fixing operation (e.g., heat and/or pressure fusing) often tend to yield imperfect contact with the photoconductive surface. Further, in the event that the copy sheet is wrinkled, the sheet will not be in intimate contact with the photoconductive surface and spaces or air gaps will materialize between the developed toner powder image on the photoconductive surface and the copy sheet. When spaces or gaps exist between the developed image and the copy substrate, various problems may result. For example, there is a tendency for toner not to transfer across gaps, causing variable transfer efficiency and, under extreme circumstances, creating areas of low toner transfer or even no transfer, resulting in a phenomenon known as image transfer deletion. Clearly, image transfer deletions are very undesirable in that useful and necessary information and indicia may not be reproduced on the copy sheet.

The problem of transfer deletion has been addressed through various approaches. For example, an acoustic agitation system incorporating a resonator suitable for generating vibratory energy arranged in line with the back side of the photoconductor to apply uniform vibratory energy thereto has been disclosed in commonly assigned U.S. Pat. No. 5,081,500 as a method for enhancing toner release from the photoreceptive surface. In accordance with the concept disclosed in that patent, toner can be released from the image bearing surface of the photoconductor despite the fact that electrostatic charges in the transfer zone may be insufficient to attract toner over to the image support substrate. Alternatively, mechanical devices, such as rollers, have been used to force the image support substrate into intimate and substantially uniform contact with the image bearing surface. For example, in the series 9000 family of electrophotographic printing and copying machines manufactured by the Xerox Corporation, an electrically biased transfer roll system is effective in substantially eliminating image deletions. In other electrophotographic printing machines, such as the Model No. 1065, also manufactured by the Xerox Corporation, the copy sheet is provided with a precisely controlled curvature as it enters the transfer station for providing enhanced contact pressure thereat. These, and other types of devices illustrating the background of this technology, are discussed in detail in U.S. Pat. No. 4,947,214.

More recently, an alternative approach for curing the transfer deletion problem has been implemented in the Xerox Corporation Model No. 5090 duplicator, wherein a flexible blade member, or so-called transfer assist blade, is urged against the copy sheet in the transfer region to press the copy sheet against the surface of the photoconductive member. This general approach has also been utilized and disclosed with respect to various configurations, wherein various contact blade arrangements and actuating devices have been proposed for sweeping against the back side of the image support substrate at the entrance to the transfer region. The following disclosures may be relevant:

U.S. Pat No. 4,947,214

Patentee: Baxendell, et al.

Issued: Aug. 7, 1990

U.S. Pat. No. 5,227,852

Patentee: R. Smith et al.

Issued: Jul. 13, 1993

U.S. Pat. No. 5,247,335

Patentee: R. Smith et al.

Issued: Sep.21, 1993

U.S. Pat. No. 5,300,993

Patentee: Vetromile

Issued: Apr. 5, 1994

U.S. Pat. No. 5,300,994

Patentee: Gross et al.

Issued: Apr.5, 1994

The foregoing disclosures may be briefly summarized as follows:

U.S. Pat. No. 4,947,214 to Baxendell et al. discloses a system for transferring a developed image from a photoconductive surface to a copy sheet, including a corona generating device and a transfer assist blade. The blade is shifted via a solenoid-activated lever arm from a nonoperative position spaced from the copy sheet, to an operative position, in contact with the copy sheet for pressing the copy sheet into contact with the developed image on the photoconductive surface to substantially eliminate any spaces therebetween during the transfer process.

U.S. Pat. No. 5,227,852 to Smith et al. discloses an apparatus for enhancing contact between a copy sheet and a developed image positioned on a photoconductive member which includes a contact member being spaced apart from the copy sheet in a first mode of operation and being in contact with the copy sheet in a second mode of operation. The apparatus of that invention includes a cam movable between a first position and a second position as well as a mechanism for moving the cam between its first position and its second position for positioning the contact member in its first mode of operation in response to the cam being moved to its first position and in its second mode of operation in response to the cam being moved to its second position.

U.S. Pat. No. 5,247,335 to Smith et al. discloses a transfer blade for ironing a sheet against a photoreceptor belt during transfer, thereby smoothing out deformities which cause deletions. The transfer blade of that patent application includes a flexible tip to absorb the impact of the blade as it contacts the paper and a spring load to limit and control the force applied to the sheet. Sensors are also utilized to monitor and adjust the timing of the transfer blade.

U.S. Pat. No. 5,300,993 to Vetromile discloses an apparatus which transfers a developed image from a photoconductive surface to a copy sheet. The apparatus includes a corona generating device arranged to charge the copy sheet for establishing a transfer field that is effective to attract the developed image from the photoconductive surface to the copy sheet and a cam-actuated blade which is moved from a nonoperative position spaced from the copy sheet, to an operative position, in contact therewith. The blade presses a copy sheet into contact with at least the developed image on the photoconductive surface for assisting transfer of the developed image to the copy sheet.

U.S. Pat. No. 5,300,994 to Gross et al. discloses an apparatus for providing substantially uniform contact between a copy substrate and a developed image located on an imaging member. The structure of that invention comprises contact means, adapted to move from a nonoperative position spaced from the imaging member to an operative position in contact with the copy substrate on the imaging member, for applying pressure against the copy substrate in a direction toward the imaging member, and means, including an elevated deflecting surface, for applying a load to the contact means to deflect the contact means into the operative position.

The entire disclosures of the above-referenced patents are hereby incorporated by reference for their relevant teachings.

It has been recognized in the above cited patents that it is desirable to provide a transfer assist apparatus of the type capable of accommodating copy substrates of various dimensions. For example, U.S. Pat. No. 5,300,993 describes an arrangement which accommodates copy substrates of various dimensions, wherein a primary segment of a transfer assist blade may be driven into an operative position either independent of a marginal segment, or in conjunction with a marginal segment (or plural marginal segments) depending on the process width of the copy sheet for applying pressure thereagainst. Thus, it is known that it is desirable to provide an arrangement suitable for applying uniform contact pressure to standard copy substrates of various sizes, such as, for example, a first copy substrate measuring 8½"×11", and a second copy substrate measuring 11"×14" (among other various standard sizes).

It is notable that the technology disclosed by the prior art is limited to providing segmented transfer assist blades corresponding to various discrete dimensions. However, these discrete dimensions may not always correspond to the dimension of the copy sheets being processed for imaging in an electrostatographic printing machine such that deficiencies in the prior art will become manifest when the length of the transfer assist blade does not exactly match the process width of the copy sheet travelling through the transfer station. Such deficiencies may be illustrated by the following example: the standard model 5090 duplicator manufactured by Xerox Corporation provides a transfer assist blade having segment lengths corresponding to copy sheets having 11", 11.7", 13", and 14" dimensions. In the case where a 10" paper width is to be processed through the transfer station, the 11" blade segment is actuated such that an inch of the transfer assist blade is exposed to the surface of the photoreceptor. The area of the blade which is exposed to the photoreceptor will, in most instances, pick up residual dirt and toner from the photoreceptor surface such that the next job run which processes copy sheets having a dimension greater than 10" will have the residual dirt picked up by the transfer assist blade transferred back to the back side of the copy sheet, resulting in an unacceptable print quality defect.

More importantly, continuous contact between the blade and the photoreceptor may cause permanent damage to the photoreceptor due to frictional forces created therebetween. In a corollary example, in the case of a copy sheet having a dimension of, for example, 12.5", the problem associated with an extended transfer assist blade, as described above, might be addressed by merely actuating the transfer assist blade segments corresponding to a copy sheet dimension of 11.7". However, in this scenario, the widthwise marginal regions of the copy sheet extending beyond the 11.7 inches will not be pressed against the photoconductive surface by the transfer assist blade such that the risk of transfer deletions intended to be addressed by the transfer assist apparatus, will not be prevented in those portions of the copy sheet extending beyond the marginal regions of the blade member.

In accordance with the present invention, there is provided an apparatus for providing substantially uniform contact between a copy sheet having a process width dimension and a developed image on an imaging surface. The apparatus comprises a contact assembly, adapted to be shifted from a nonoperative position spaced from the imaging surface, to an operative position in contact with the copy sheet on the imaging surface, for pressing the copy sheet thereagainst, and means for providing a continuously variable length to the contact assembly to correspond with the process width dimension of the copy sheet.

Pursuant to another aspect of the present invention, there is provided an electrophotographic printing machine including a transfer station for transferring a developed image from a moving imaging member to a moving copy substrate, including an apparatus for providing substantially uniform intimate contact between the copy substrate and the developed image located on the imaging member, comprising: contact means, adapted to be shifted from a nonoperative position spaced from the imaging surface, to an operative position in contact with the copy substrate on the imaging member, for pressing the copy substrate thereagainst; and means for providing a continuously variable length to the contact means to correspond with the process width dimension of the copy substrate.

Other aspects of the present invention will become apparent as the following description proceeds and upon reference to the drawings, in which.

While the present invention will hereinafter be described in connection with a preferred embodiment and method of use, it will be understood that it is not intended to limit the invention to that embodiment or method of use. On the contrary, the following description is intended to cover all alternatives, modifications, and equivalents, as may be included within the spirit and scope of the invention as defined by the appended claims. Other aspects and features of the present invention will become apparent as the following description progresses.

Figure 2:
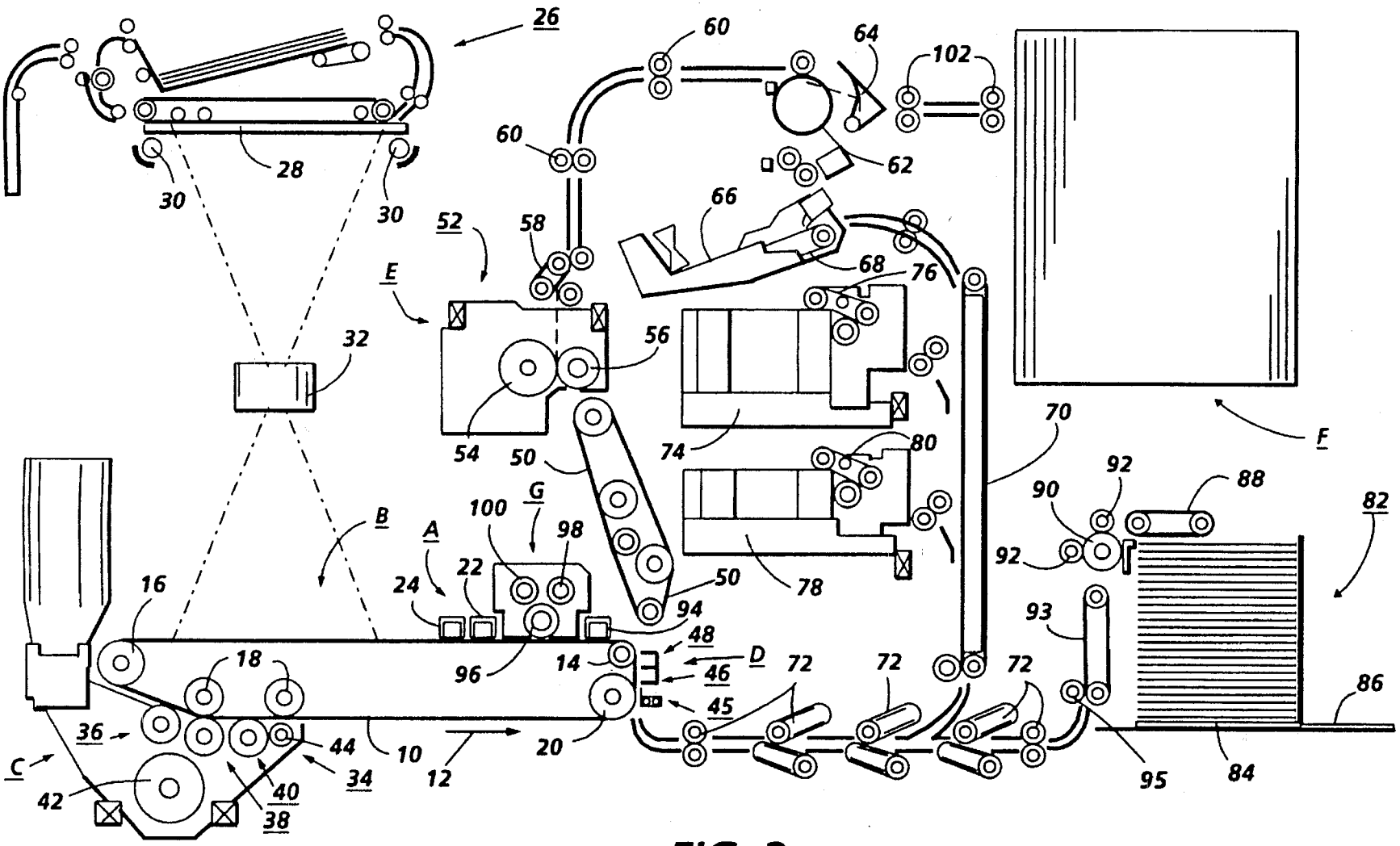
FIG. 2 is a schematic elevational view of an exemplary electrophotographic printing machine incorporating the variable length transfer assist contact assembly and apparatus of the present invention.

For a general understanding of the features of the present invention, reference is made to the drawings, wherein like reference numerals have been used throughout to identify identical or similar elements. Turning initially to FIG. 2, prior to discussing the invention in detail, a schematic depiction of an exemplary electrophotographic reproducing machine incorporating various machine components is furnished in order to provide a general background and understanding of the features of the present invention. Although the apparatus of the present invention is particularly well adapted for use in an automatic electrophotographic reproducing machine as shown in FIG. 2, it will become apparent from the following discussion that the adjustable transfer assist blade and actuating apparatus of the present invention is equally well suited for use in a wide variety of electrostatographic processing machines as well as many other known printing systems. It will be further understood that the present invention is not necessarily limited in its application to the particular embodiment or embodiments shown and described herein.

The exemplary electrophotographic printing machine of FIG. 2 employs a photoconductive belt 10, preferably comprising a photoconductive material coated on a ground layer, which, in turn, is coated on an anti-curl substrate. Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under a specific predetermined tension. Drive roller 20 is rotated by a motor (not shown) coupled thereto by any suitable means such as a drive belt or the like, such that the rotation of roller 20 advances belt 10 in the direction of arrow 12 to transport successive portions of the photoconductive surface sequentially through the various processing stations disposed about the path of movement of the belt 10.

Initially, a portion of photoconductive belt 10 passes through charging station A whereat two corona generating devices, indicated generally by the reference numerals 22 and 24 charge photoconductive belt 10 to a relatively high, substantially uniform potential. This dual or "split" charging system is designed so that corona generating device 22 places all of the required charge on photoconductive belt 10 while corona generating device 24 acts as a leveling device to provide a uniform charge across the surface of the belt. Corona generating device 24 also fills in any areas missed by corona generating device 22.

Next, the charged portion of belt 10 is advanced through imaging station B defined by a document handling unit, indicated generally by reference numeral 26, positioned in alignment with an imaging station, which may include a platen 28. Imaging of the document is achieved by two flash lamps 30 mounted in the optics cavity for illuminating the document on platen 28. Light rays reflected from the document are transmitted through lens 32 which focuses the light image of the original document onto the charged portion of the photoconductive surface of belt 10 to selectively dissipate the charge thereon. This records an electrostatic latent image on photoconductive belt 10 corresponding to the informational areas contained within the original document. Thereafter, photoconductive belt 10 advances the electrostatic latent image recorded thereon to development station C. It is noted that original input documents can be automatically positioned onto platen 28 by means of a belt transport which is lowered onto the platen with the original document being interposed between the platen and the belt transport. When the original document is properly positioned on platen 28, the document is imaged and the original document is returned to the document tray from platen 28 by either of two paths. If a simplex copy is being made or if this is the first pass of a duplex copy, the original document is returned to the document tray via a simplex path. If this is the inversion pass of a duplex copy, then the original document is returned to the document tray through a duplex path.

At development station C, a magnetic brush developer housing, indicated generally by reference numeral 34, is provided, having three developer rolls, indicated generally by the reference numerals 36, 38 and 40. A paddle wheel 42 picks up developer material in the developer housing and delivers it to the developer rolls. When the developer material reaches rolls 36 and 38, it is magnetically split between the rolls with approximately half of the developer material being delivered to each roll. Photoconductive belt 10 is partially wrapped about rolls 36 and 38 to form an extended development zones. Developer roll 40 is a cleanup roll and magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet (not shown) is moved into contact with the toner powder image on belt 10. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D where the developed image on belt 10 contacts the advancing sheet of support material in a timed sequence for transfer of the image thereto.

As can be seen in the illustrated embodiment, a corona generating device 46 charges the copy sheet to a proper potential so that the sheet is electrostatically secured or "tacked" to belt 10 and the toner image thereon is attracted to the copy sheet. As previously discussed, it is not uncommon for air gaps or spaces to exist between the copy sheet and the surface of the belt 10. For example, some printing applications require imaging onto high quality papers having surface textures which prevent intimate contact of the paper with the developed toner images. In duplex printing systems, even initially flat paper can become cockled or wrinkled as a result of paper transport and/or the first side fusing step. Also, color images can contain areas in which intimate contact of toner with paper during the transfer step is prevented due to adjacent areas of high toner pile heights. The lack of uniform intimate contact between the belt and the copy sheet in these situations can inhibit transfer and may result in so-called transfer deletions, i.e., image areas where transfer has failed to occur. Contact assisted transfer, as provided by the present invention, is a technique that helps reduce the occurrence of such deletions by urging the copy sheet into intimate contact with the photoreceptor belt 10 to eliminate or minimize the factors that may retard toner migration toward the copy substrate. In addition, such uniform intimate contact provides increased transfer efficiency with lower than normal transfer fields, which not only yields better copy quality, but also results in improved toner use efficiency as well as a reduced load on the cleaning system.

In accordance with the present invention, the interface between the sheet feeding apparatus and transfer station D includes an apparatus for applying uniform contact pressure to the sheet as it is advanced toward belt 10. Thus, the copy sheet is advanced along a sheet path for contacting the toner powder image on the photoconductive surface, assisted by a transfer assist apparatus, indicated generally by the reference numeral 45. The transfer assist apparatus 45 includes a variable length for pressing the copy sheet into contact with the surface of the photoreceptor. In addition, a light sensor (not shown) may be provided for detecting the leading edge of the copy sheet as it enters the transfer station D or as the copy sheet travels through an area of the machine prior to delivery to the transfer station. The signal from the light sensor is processed by a circuit for controlling the actuation of the blade assembly which is moved from a nonoperative position, spaced from the photoconductive belt 10 to an operative position, contacting the back side of the copy sheet interposed between the blade and the belt. In the operative position, the blade presses the copy sheet into contact with the toner powder image developed on photoconductive belt 10 for substantially eliminating any spaces between the copy sheet and the toner powder image to insure that the copy sheet is in substantially intimate contact with the belt 10. The blade is mounted on rotatable member for facilitating movement of the blade between the operative and nonoperative positions.

In conjunction with the transfer assist apparatus 45, a corona generating device 46 charges the copy sheet to the proper magnitude and polarity so that the copy sheet is tacked to photoconductive belt 10 and the toner powder image is electrostatically attracted from the belt 10 to the copy sheet. Thereafter, the copy sheet moves in unison with photoconductive belt 10, in the direction of arrow 12. As the trailing edge of the copy sheet passes the light sensor, the light sensor again transmits a signal to a processing circuit for shifting the contact blade assembly to its nonoperative position. In the nonoperative position, the blade is spaced from the copy sheet and the photoconductive belt, insuring that blade does not scratch the photoconductive belt or accumulate toner particles thereon which might otherwise be deposited on the backside of the next successive copy sheet. Exemplary of light sensors and delay circuits suitable for use with the described transfer assist apparatus are known, as for example that described in U.S. Pat. No. 4,341,456 issued to Iyer et al. in 1982, the relevant portions thereof being hereby incorporated into the present application. Further details of the transfer assist apparatus of the present invention will be described hereinafter with reference to FIG. 1.

Continuing now with the general description of an exemplary electrophotographic printing machine as shown in FIG. 2, it is noted that, after transfer, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to fusing station E.

Fusing station E includes a fuser assembly, indicated generally by the reference numeral 52, which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller 56 abuts the fuser roller 54 to provide the necessary pressure to fix the toner powder image to the copy sheet. In this fuser assembly, the fuser roll 54 is internally heated by a quartz lamp while a release agent, stored in a reservoir, is pumped to a metering roll which eventually applies the release agent to the fuser roll.

After fusing, the copy sheet is fed through a decurling apparatus 58 which bends the copy sheet in one direction to put a known curl in the copy sheet, thereafter bending the copy sheet in the opposite direction to remove that curl, as well as any other curls or wrinkles which may have been introduced into the copy sheet. The copy sheet is advanced, via forwarding roller pairs 60 to duplex turn roll 62.

At this point, duplex solenoid gate 64 selectively guides the copy sheet either to finishing station F or to duplex tray 66. If the copy sheet is advanced to the finishing station, the copy sheets are collected in sets and the copy sheets of each set can be stapled or glued together. Alternatively, if gate 64 diverts the sheet into duplex tray 66, those sheets that have been printed on one side and on which an image is to subsequently printed on the second, opposed side thereof (i.e. duplex printing) are stacked and temporarily stored in a duplex tray 66 in the order in which they are copied. In order to complete duplex copying, the simplex sheets stored in tray 66 are fed, in seriatim, by a bottom feeder 68 from tray 66 back to transfer station D, via conveyor 70 and rollers 72, for transfer of the toner powder image to the opposite side of the copy sheets. Once again blade 45 is actuated and moved from the nonoperative position to the operative position. After the copy sheet exits the transfer station, blade 45 is actuated once again and returned to the nonoperative position. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

It is noted that copy sheets may also be fed to transfer station D from a secondary tray 74 which includes an elevator driven by a bidirectional AC motor and a controller having the ability to drive the tray up or down. When the tray is in the down position, stacks of copy sheets are loaded thereon or unloaded therefrom. In the up position, successive copy sheets may be fed therefrom by a sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from an auxiliary tray 78. As in the case of the secondary tray 74, the auxiliary tray 78 includes an elevator driven by a bidirectional AC motor and a controller having the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D. Secondary tray 74 and auxiliary tray 78 are supplemental sources of copy sheets.

Invariably, after the copy sheet is separated from photoconductive belt 10, some residual particles remain bonded thereto. After transfer, photoconductive belt 10 passes beneath yet another corona generating device 94 which charges the residual toner particles to the proper polarity for breaking the bond between the toner particles and the belt. Thereafter, a precharge erase lamp (not shown), located inside the loop formed by photoconductive belt 10, discharges the photoconductive belt in preparation for the next charging cycle. Residual particles are removed from the photoconductive surface at cleaning station G. Cleaning station G includes an electrically biased cleaner brush 96 and two waste and reclaim de-toning rolls 98 and 100. The reclaim roll 98 is electrically biased negatively relative to the cleaner roll 96 so as to remove toner particles therefrom while the waste roll 100 is electrically biased positively relative to the reclaim roll 98 so as to remove paper debris and wrong sign toner particles. The toner particles on the reclaim roll 98 are scraped off and deposited in a reclaim auger (not shown), where they are transported out of the rear of cleaning station G.

The various machine operations are regulated by a controller (not shown) which is preferably a programmable microprocessor capable of managing all of the machine functions and subsystems hereinbefore described. Programming conventional or general purpose microprocessors to execute imaging, printing, document, and/or paper handling control functions and logic with software instructions is well known and commonplace as taught by various prior patents and commercial products. Such programing or software may, of course, vary, depending on the particular functions, software type, and microprocessor or other computer system utilized, but will be available to those of skill in the software and/or computer arts, or the controller will be readily programmable without undue experimentation from, functional descriptions, such as those provided herein, or prior knowledge of functions which are conventional, together with general knowledge in the software and computer arts. Thus, the controller may be programmed to provide a comparison count of the copy sheets, the number of documents being recirculated, the number of copy sheets selected by the operator, time delays, and jam indications, among other various functions including transfer assist blade actuation and variable blade length adjustment,as provided by the present invention. In addition, the controller may regulate the various positions of gates and switching depending upon the mode of operation selected. The operation of all of the exemplary systems described hereinabove may be accomplished by conventional user interface control switch inputs selected by the operator from the printing machine consoles. Conventional sheet path sensors or switches may be utilized to keep track of the position of documents and copy sheets in the machine.

The foregoing description should be sufficient for the purposes of the present application for patent to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the present invention.

Figure 1:
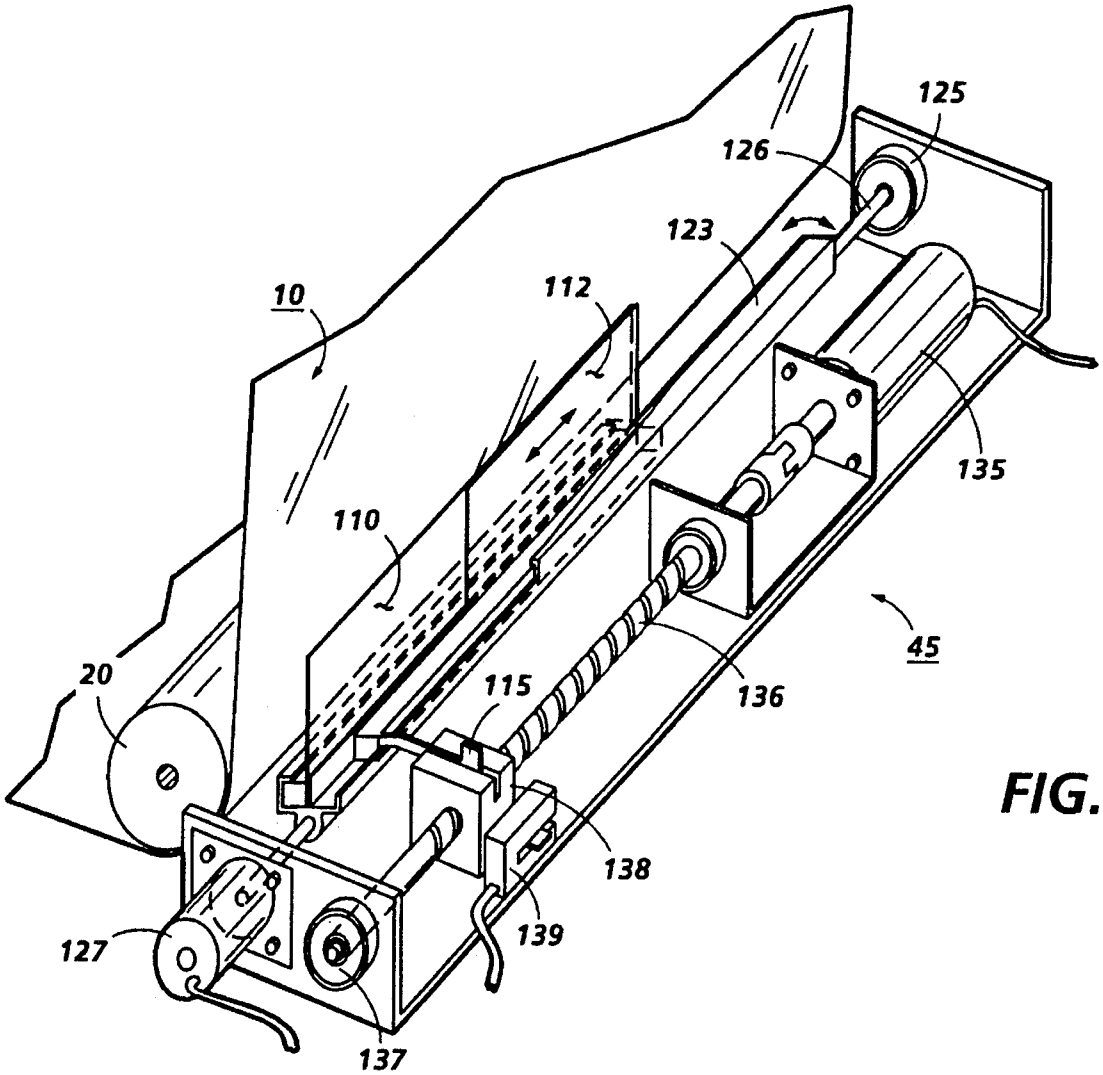
FIG. 1 is a perspective view of a transfer assist apparatus including a variable length transfer assist contact assembly in accordance with the present invention including an illustration of an exemplary actuation mechanism for varying the length of the blade assembly.

Moving now to the particular features of the transfer assist apparatus and the variable length contact assembly of the present invention, reference is made to FIG. 1, wherein a transfer assist apparatus is depicted in an enlarged perspective view. It will be understood that corotrons 46 and 48 have been deleted from this figure for purposes of clarity.

In accordance with the present invention, the transfer station D includes a transfer assist apparatus 45 of the type generally described hereinabove, wherein an apparatus is provided for pressing a copy sheet against the photoconductive surface to insure that the copy sheet is in substantially intimate contact with the photoconductive surface so as to enhance the toner powder image transfer process. The transfer assist apparatus 45 of the present invention includes a variable length contact assembly including a primary blade member 110 and a secondary blade member 112 extending along a substantially common longitudinal axis substantially parallel to the surface of belt 10. Each blade member is fabricated from a resilient, flexible material, as for example, Mylar, manufactured by E. I. DuPont de Nemours, Co. of Wilmington, Del. Blade members 110 and 112 are each mounted in an extrusion housing 123 which, in turn, is mounted on a rotatable shaft 126 for providing selective positioning of the contact assembly relative to the photoconductive surface of belt 10. Thus, in the illustrated embodiment, the rotatable shaft 126 is coupled to a stepper motor 127 for selectively rotating the rotatable shaft to shift the transfer assist blade between an operative and a nonoperative position, wherein the operative position is defined by the contact assembly pressing a copy sheet into contact with the toner powder image developed on the photoconductive surface of belt 10, while the nonoperative position is defined by the contact assembly being spaced from the copy sheet and the photoconductive belt 10 such that no contact engagement exists therebetween. It will be understood that shifting between the operative and nonoperative positions is occasioned by the presence or absence of a copy sheet in the transfer station region such that some known apparatus for detecting the leading or the trailing edge of the copy sheet is incorporated into the contact assembly of the present invention. The embodiment described herein and shown in FIG. 1 is intended to disclose a preferred embodiment of the present invention only. Those of skill in the art will appreciate that various embodiments for selectively positioning the transfer assist apparatus, such as a solenoid device or a cam assisted assembly, may be implemented, including, but by no means limited to, the various embodiments disclosed in the patents cited herein as being relevant to the present invention. Thus, it will be understood that the stepper motor shown in FIG. 1 represents one of various means for selectively rotating the rotatable shaft for positioning the contact assembly and that numerous other apparatus or systems may be incorporated into the present invention for facilitating the same or a similar function.

In accordance with a specific feature of the present invention, the contact assembly includes a pair of blade members which are cooperative for providing a continuously variable length to the contact assembly to correspond with the process width of a copy sheet. Thus, the contact assembly comprises a primary blade member 110 which is fixedly mounted in the extrusion housing 123 while the secondary blade member 112 which is slidably mounted in the extrusion housing 123 so as to be selectively positionable along the longitudinal axis thereof. In a preferred embodiment, the primary transfer assist blade segment 110 has a length corresponding to the smallest process width dimension of a copy sheet contemplated for use in the machine. The blade 110 is fixedly mounted such that the outboard end thereof is in alignment with the outboard edge of the photoreceptor belt 10. The secondary transfer assist blade segment can be any length which is shorter than the primary assist blade segment and preferably has a length such that the cumulative length of the primary blade segment and the secondary blade segment matches the greatest process width dimension of a copy sheet contemplated for use in the machine, typically the width of the photoconductive belt 10. Blade segment 112 is slidably mounted in a channel of the extrusion housing 123, which permits the secondary blade segment 112 to be positioned at various locations ranging from completely behind the primary segment 110 (relative to belt 10) to various locations extending beyond the primary segment 110 along the longitudinal axis thereof, such that the cumulative length of the transfer assist blade corresponds with the process width of the copy sheet being processed through the transfer station D. Thus, for example, in a machine having a 10" long primary blade, processing a copy sheet having a 10" process width, the secondary segment is positioned completely behind the primary segment 110. However, when the process width of the copy sheet is greater than the length of the primary transfer assist blade segment 110, the secondary segment is shifted in an inboard direction to a position such that the inboard edge of the secondary segment precisely corresponds to the position of the inboard edge of the copy sheet. The copy sheet is pressed against the surface of the photoconductive belt by both the primary transfer assist blade and the secondary transfer assist blade segment. Obviously, the secondary transfer assist blade segment will have a length slightly longer than the maximum length to which it may be extended for insuring that an overlap exists between the two blade segments when extended to its greatest dimension.

As can be seen in FIG. 1, the transfer assist apparatus of the present invention is also provided with a positioning assembly for selectively varying the position of the secondary blade segment 112 in accordance with the process width of the copy sheet. An exemplary embodiment of an illustrative positioning assembly in accordance with the present invention includes a blade positioning block 138 which is cooperative with a flag member 115 extending from the secondary transfer assist blade segment 112 for being detachably coupled to the blade positioning block 138 so that the transfer assist blade can be shifted between the operative and nonoperative position independent of the blade positioning assembly. The blade positioning block 138 engages with a threaded shaft member 136 extending along an axis substantially parallel to the longitudinal axis of the extrusion housing and, in turn, substantially parallel to the photoreceptor belt. The threaded shaft 136 is coupled to a stepper motor 135 for selectively inducing rotation thereof. The, threaded shaft 136 is cooperatively engaged with the blade positioning block 138 such that rotation of the threaded shaft 136 is operative to displace the blade positioning block along the previously defined longitudinal axis and generally transverse to the process direction of travel of the copy sheet. Thus, the stepper motor 135 rotates the threaded shaft 136 for displacing the blade positioning block 138 which, in turn, displaces the secondary transfer assist blade member 112. A positional sensor 139 is also provided for monitoring the position of the blade positioning block 138. In a preferred embodiment, the positional sensor 139 includes a detection device for detecting the presence of the blade positioning block 138 at a so-called "home position" corresponding to the secondary transfer assist blade segment 112 being positioned behind the primary transfer assist blade segment 110. The positioning block 138 is returned to this home position between each print job so that subsequent selective positioning of the secondary transfer assist blade segment 112 is monitored as a function of the number of steps or the amount of rotation provided by the stepper motor 135. By returning the positioning block 138 to its home position between each print job, a significant reduction in positioning errors can be expected. It will be understood, however, that various positioning and position monitoring schemes and apparatus may be incorporated into the present invention.

In describing the operation of the present invention, a copy sheet is transported into the transfer station where a light sensor provides an indication of the presence of the copy sheet as it enters the transfer station, transmitting a signal which actuates the contact assembly to shift the transfer assist blade in the direction of the photoconductive belt. The blade is thus positioned into contact engagement with the copy sheet against the belt 10 for substantially eliminating any spaces between the copy sheet and the toner powder image to significantly improve transfer of the toner powder image to the copy sheet. The transfer assist blade has a continuously variable length, whereby a positioning assembly is provided for extending the length of the transfer assist blade to correspond with the process width of the copy sheet travelling through the transfer station. Thus, when the operator selects the copy sheet size for a particular print job, a secondary transfer assist blade segment is displaced along a longitudinal axis parallel to the photoreceptor belt so that the cumulative length of the primary transfer assist blade segment and the secondary transfer assist blade segment corresponds to the process width of the copy sheet. The continuously variable length transfer assist blade system described herein eliminates dirt and deletion print quality defects resulting from a mismatch between the length of the transfer assist blade and the process width of the copy sheet. In addition, the variable length transfer blade assembly eliminates the need for providing different hardware configurations, such as discrete length segments, for corresponding standard copy sheet dimensions.

In review, the transfer apparatus of the present invention includes a variable length contact assembly, normally spaced from the photoconductive surface, in a nonoperative position, which can be shifted to an operative position, pressing the copy sheet into intimate contact with the toner powder image developed on the photoconductive belt for transfer of toner therefrom. The variable length contact assembly includes a pair of blade segments wherein at least one blade segment is slidably mounted along a longitudinal axis for selectively extending the length of the contact assembly. A positioning assembly is also provided for cooperative engagement with the slidably mounted blade segment to extend the length of the contact assembly in response to the process width dimension of the copy sheet.

It is, therefore, evident that there has been provided, in accordance with the present invention, a transfer assist apparatus that fully satisfies the aims and advantages hereinbefore set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for providing substantially uniform contact between a copy sheet having a process width dimension and a developed image on an imaging surface, comprising:

a contact assembly, adapted to be shifted from a nonoperative position spaced from the imaging surface, to an operative position in contact with the copy sheet on the imaging surface, for pressing the copy sheet thereagainst, wherein said contact assembly includes:

a fixedly mounted primary blade member; and a slidably mounted secondary blade member;

said primary blade member and said secondary blade member being mounted along a substantially common longitudinal axis extending substantially parallel to the imaging surface, and means for providing a continuously variable length to said contact assembly to correspond with the process width dimension of the copy sheet.

2. The apparatus of claim 1, wherein said means for providing a continuously variable length includes means for selectively positioning said slidably mounted secondary blade member along the longitudinal axis such that a cumulative length of said fixedly mounted primary blade member and said slidably mounted secondary blade member corresponds to the process width dimension of the copy sheet.

3. The apparatus of claim 1, further including:

means, cooperative with said slidably mounted secondary blade member, for providing selective positioning thereof along the substantially common longitudinal axis.

4. The apparatus of claim 3, wherein said positioning means includes:

a positioning member coupled to said slidably mounted secondary blade member; and a threaded shaft extending along an axis substantially parallel to the substantially common longitudinal axis;

said positioning member and said threaded shaft being cooperatively engaged such that rotation of said threaded shaft is operative to displace said positioning member for selectively positioning said slidably mounted secondary blade member along the longitudinal axis.

5. The apparatus of claim 4, further including means for rotating said threaded shaft in response to an indication of the process width of the copy sheet to selectively position said slidably mounted secondary blade member in accordance with the indication of the process width of the copy sheet.

6. The apparatus of claim 5, wherein said rotating means includes a stepper motor for rotating said threaded shaft to precisely position said slidably mounted secondary blade member.

7. The apparatus of claim 1, further including means for shifting said contact assembly into the operative position in response to detection of a leading edge of the copy sheet contacting the developed image on the imaging surface.

8. The apparatus of claim 7, wherein said shifting means is further adapted to for shifting said contact assembly into the nonoperative position in response to detection of a trailing edge of said copy sheet passing under said contact assembly.

9. An electrostatographic printing machine including a transfer station for transferring a developed image from a moving imaging member to a moving copy substrate, including an apparatus for providing substantially uniform intimate contact between the copy substrate and the developed image located on the imaging member, comprising:

contact means, adapted to be shifted from a nonoperative position spaced from the imaging surface, to an operative position in contact with the copy substrate on the imaging member, for pressing the copy substrate thereagainst, wherein said contact means includes:

a fixedly mounted primary blade member; and a slidably mounted secondary blade member;

said primary blade member and said secondary blade member being mounted along a substantially common longitudinal axis extending substantially parallel to the imaging member; and means for providing a continuously variable length to said contact means to correspond with the process width dimension of the copy substrate.

10. The electrostatographic printing machine of claim 9, wherein said means for providing a continuously variable length includes means for selectively positioning said slidably mounted secondary blade member along the longitudinal axis such that a cumulative length of said fixedly mounted primary blade member and said slidably mounted secondary blade member corresponds to the process width dimension of the copy substrate.

11. The electrostatographic printing machine of claim 9, further including:

means, cooperative with said slidably mounted secondary blade member, for providing selective positioning thereof along the substantially common longitudinal axis.

12. The electrostatographic printing machine of claim 11, wherein said selective positioning means includes:

a positioning member coupled to said slidably mounted secondary blade member; and a threaded shaft extending along an axis substantially parallel to the substantially common longitudinal axis;

said positioning member and said threaded shaft being cooperatively engaged such that rotation of said threaded shaft is operative to displace said positioning member for selectively positioning said slidably mounted secondary blade member along the longitudinal axis.

13. The electrostatographic printing machine of claim 12, further including means for rotating said threaded shaft in response to an indication of the process width of the copy substrate to selectively position said slidably mounted secondary blade member in accordance with the indication of the process width of the copy sheet.

14. The electrostatographic printing machine of claim 13, wherein said rotating means includes a stepper motor for rotating said threaded shaft to precisely position said slidably mounted secondary blade member.

15. The electrostatographic printing machine of claim 9, further including means for shifting said contact assembly into the operative position in response to detection of a leading edge of the copy substrate contacting the developed image on the imaging member.

16. The electrostatographic printing machine of claim 15, wherein said shifting means is further adapted to shift said contact assembly into the nonoperative position in response to detection of a trailing edge of said copy substrate passing under said contact means.

17. The electrostatographic printing machine of claim 9, wherein said transfer station further includes at least one corona generating device for electrostatically attracting the developed image from the imaging member to the copy substrate.

* * * * *